US010898406B2

(12) United States Patent
McAteer

(10) Patent No.: US 10,898,406 B2
(45) Date of Patent: Jan. 26, 2021

(54) COLLAPSABLE SAFETY CANE WITH SHOCK ABSORBING FEATURE

(71) Applicant: John McAteer, High Ridge, MO (US)

(72) Inventor: John McAteer, High Ridge, MO (US)

( * ) Notice: Subject to any disclaimer, the term of this patent is extended or adjusted under 35 U.S.C. 154(b) by 0 days.

(21) Appl. No.: 16/873,198

(22) Filed: Feb. 25, 2020

(65) Prior Publication Data

US 2020/0276074 A1 Sep. 3, 2020

Related U.S. Application Data

(60) Provisional application No. 62/919,221, filed on Mar. 1, 2019.

(51) Int. Cl.

| | |
|---|---|
| ***A61H 3/02*** | (2006.01) |
| ***A45B 9/02*** | (2006.01) |
| ***A45B 9/04*** | (2006.01) |
| *A45B 9/00* | (2006.01) |

(52) U.S. Cl.

CPC ..... *A61H 3/0277* (2013.01); *A45B 9/02* (2013.01); *A45B 9/04* (2013.01); *A45B 2009/007* (2013.01)

(58) Field of Classification Search

CPC ..... A45B 3/0277; A45B 9/02; A61H 3/06; A61H 3/0277

USPC ..... 135/65, 74, 76

See application file for complete search history.

(56) References Cited

U.S. PATENT DOCUMENTS

| | | | | | |
|---|---|---|---|---|---|
| 788,541 | A | * | 5/1905 | Kunkel | A61H 3/0288 135/65 |
| 1,723,780 | A | | 8/1929 | Hayhoe | |
| 2,144,858 | A | | 1/1939 | Smith | |
| 3,158,162 | A | | 11/1964 | Reel | |
| 3,669,133 | A | * | 6/1972 | Hyman | A45B 9/00 135/74 |
| RE28,067 | E | * | 7/1974 | Hyman | A45B 7/00 135/74 |
| 3,963,037 | A | * | 6/1976 | Clark | A61H 3/068 135/65 |
| 4,236,544 | A | | 12/1980 | Osaka | |
| 4,562,850 | A | | 1/1986 | Earley et al. | |

(Continued)

FOREIGN PATENT DOCUMENTS

| | | |
|---|---|---|
| CN | 95215513.3 | 4/1996 |
| CN | 201720412746.2 | 12/2017 |

(Continued)

*Primary Examiner* — Noah Chandler Hawk

(74) *Attorney, Agent, or Firm* — Paul M. Denk

(57) ABSTRACT

A shock absorbing handle for a white cane for blind people or visually impaired, incorporates resilient members within its handle, primarily in the form of a spring located in the handle region of the cane, in order to cushion the impact when the lower tip of the cane encounters an obstruction. A length of resilient cord, such as a bungee cord, extends from the top of the handle of the cane, to the lower tip of its bottom most segment, so that when the cord is stretched, the various segments can be separated from their connecting ferrules, and contracted into a smaller size for packaging. The various segments can be stretched, through their resilient cord, and secured together, to form the lengthy white cane, having cushioning impact provided within its handle, to relieve stress upon the user, when obstructions are encountered during usage of the cane during its application.

1 Claim, 2 Drawing Sheets

(56) References Cited

U.S. PATENT DOCUMENTS

| | | | | |
|---|---|---|---|---|
| 4,625,742 | A | 12/1986 | Phillips | |
| 5,331,990 | A | 7/1994 | Hall et al. | |
| 5,443,435 | A | 8/1995 | Wilkinson | |
| 5,495,867 | A | 3/1996 | Block | |
| 5,573,025 | A | 11/1996 | Atlas | |
| 5,586,957 | A | 12/1996 | Wilkinson | |
| 6,055,998 | A | 5/2000 | Bader | |
| 6,131,592 | A | 12/2000 | Panizza | |
| 6,254,134 | B1 * | 7/2001 | Panizza | A45B 9/00 135/82 |
| 6,898,824 | B2 * | 5/2005 | Zaltron | A63C 11/221 135/66 |
| 7,445,016 | B1 | 11/2008 | Ortiz | |
| 7,841,353 | B2 * | 11/2010 | Lee | A45B 9/00 135/74 |
| 8,393,342 | B2 | 3/2013 | Goldberg et al. | |
| 8,985,130 | B2 * | 3/2015 | Howarth | A45B 9/00 135/74 |
| D747,867 | S | 1/2016 | Woodall | |
| 9,516,933 | B2 | 12/2016 | Woodall et al. | |
| 2007/0252375 | A1 * | 11/2007 | Roiser | F16F 13/007 280/816 |
| 2011/0073146 | A1 | 3/2011 | Miller | |
| 2014/0041702 | A1 * | 2/2014 | Yamamoto | A45B 9/02 135/77 |
| 2016/0278490 | A1 | 9/2016 | Rieker | |

FOREIGN PATENT DOCUMENTS

| | | |
|---|---|---|
| JP | 3056656 U | 8/1998 |
| WO | WO2012/044018 | 5/2012 |

* cited by examiner

COLLAPSABLE SAFETY CANE WITH SHOCK ABSORBING FEATURE

FIELD OF THE INVENTION

This invention generally relates to what is identified as the white cane for the blind or visually impaired person, and more specifically pertains to a white cane that includes shock absorbing features, in order to relieve the eventually painful and harmful impact upon the hand of the user, while at the same time, providing a walking stick type cane that can be collapsed, into a much smaller configuration, for ease of packaging and conveyance, as when not in usage.

BACKGROUND OF THE INVENTION

Visually impaired blind people have been using white canes for years. Statistics indicate, that there are approximately 700,000 visually impaired or disabled individuals in the United States, as of statistics accumulated during the year 2015. Many of these disabled individuals are non-institutionalized individuals, and therefore, many live at home, or some residence, and need to use some type of a cane, or walking stick, generally identified as a white cane, in order to move about the premises, or elsewhere, in undertaking daily routines. When using such a white cane, frequently the user will encounter and obstruction, that the cane abruptly impacts, transmits this force back to the hand and wrist of the user, and when such activity is repeated over and over during the day, it does have the effect of generating a degree of pain in the hand and wrist, not too unlike that eventually developing to those suffering from the carpal tunnel syndrome effect. Thus, there is a need to lessen the effects of such repeated impacts, that can alleviate the generation of such impacted pain, to enhance the livelihood of the visually impaired, in just trying to maintain a normal lifestyle, each day.

Generally, the visually impaired and blind people have been utilizing white canes for years, and white canes are generally used for mobility allowing the user to discover obstacles in front and to the side, in their path. This aides in preventing the user from walking into dangerous objects and pitfalls. All one needs to do is simply close their eyelids, take a step, and see what life is like for the visually impaired.

As stated, the problem that develops from using a cane is that when a blunt object is struck, there is a sharp impact to the wrist or abdomen. After daily or prolonged usage, the wrist develops springs or arthritis, as known in the art, and becomes extremely painful and sore, after a period of time. The abdomen will also become bruised and sore. The inventor herein is subject to that type of life experience.

With the current invention, the shock absorbing handle absorbs most of the shock, preventing these types of injuries.

The inventor herein is blind, and has been using a white cane for years, and knows firsthand the problems that result from using a cane. A person that is not blind or visually impaired is not aware of these problems. The inventor has been relentlessly developing a safer and more user friendly cane. Hence, as built into the current invention, the shock absorbing handle is a much needed development in the use of such a white cane.

A variety of prior patents and publications have existed, relating to modifications to the white cane, for the blind person. For example, it can be seen that there are patents with springs in the handles, such as shown in the shock-absorbing cane of U.S. Pat. No. 7,445,016, to Ortiz. The use of a spring means within the shank of a cane system, can be seen in the U.S. Pat. No. 9,516,933, identified as a shock absorber cane system, as developed by Woodall, et al. U.S. Pat. No. 8,393,342, to Goldberg, et al., shows another type of walking cane, with a spring provided at its downward location, apparently for providing shock absorbing means, at that location. Published application No. US2016/0278490, to Rieker, shows another type of lighted cane incorporating a shock absorber. This published application, shows a strong spring, apparently somewhere along its shaft, to function for shock absorbing purposes. The U.S. Pat. No. 5,482,072, to Cimino, shows a rather versatile and universal handle for a variety of uses, including for use on a long cane. U.S. Pat. No. 6,131,592, to Panizza, shows a shock absorbing walking stick. U.S. Pat. No. 3,158,162, to Reel, shows a blind man's walking cane, which includes a substantial spring within its lengthy structure, as can be noted. The Chinese published application No. 201711316935.0, shows a spring arranged between its handle, and the upper part of its shaft, as can be noted. The patent to Atlas, U.S. Pat. No. 5,573,025, shows a cane with engaging member. The WIPO published application No. WO2012/044018, shows a shock absorber for a mountain climbing stick, which does include a handle, that apparently affixes onto the upper end of its stick, and has a spring means intermediate thereof, apparently for shock absorbing purposes. Finally, U.S. Pat. No. 5,331,990, shows a safety cane that incorporates illumination means.

With regard to the collapsibility of a safety cane, U.S. Pat. No. 5,443,435, shows an adjustable length, adjustable weight, adjustable shock absorption, multi-purpose exercise/sports pole, but this appears to be more of a exercising device, rather than a safety cane. But, it is known that the use of a bungee cord within lengthy rod segments, that can be connected together, to complete the overall length of the rod, or which can pulled apart, dismantled, and reduced substantially in size to various tube lengths, has been used extensively in the camping tent field, as known in the art.

The foregoing are examples of prior art known to the Applicant, having relationship and experience to the subject matter of the current invention.

SUMMARY OF THE INVENTION

The concept of this invention is to provide a safety cane for the blind, or visually impaired. Generally, it relates to a lengthy shaft, made up of segmented sections, the various sections being held together by a bungee cord, that is arranged generally interiorly of the lengthy cane or walking type stick, from its lower and bottom tipped end of the cane, all the way into the handle portion, so that the cane, when assembled together, its various segments produce a lengthy cane, having sufficient length and strength to function as a walking type of stick, in order to guide the visually impaired during movement. Since a bungee type cord extends from the lower tip, up into the handle portion of the cane, the various segments of the cane can be separated from each other, by loosening one segment of the cane from a ferrule or sleeve that is associated with the next adjacent segment, so that the various sections can be separated, but yet held together by the resilient bungy type of cord, and then placed adjacent each other, into a much reduced size, to allow the collapsed cane to be located within its carrier, for conveyance or storage, as when not in usage. But, the various segments can be coupled together, and held together through the resilience of the elastic cord provided therein, and even have a handle provided at the upper end, for the convenience of its handling and usage. The handle may be ergonomically designed, so as to allow the user to more easily hold onto the cane, during usage.

Another primary feature of this invention is that the handle is spring biased in its connection to the top segment of the cane, so that when an obstruction is encountered by the user when attempting to move, or walk, the flexibility of the spring within the handle will allow the handle to slide longitudinally, for a short distance, upon the upper segment of the cane, so as to cushion the impact encountered by the cane, and the hand or wrist of the user, during application of this improved device. The consequences of repeated impacting obstructions while using this cane as an assistance to walking, for the visually impaired, has already been reviewed herein.

Furthermore, the bungee type cord extends entirely through the cane, and can even locate exteriorly of the top of the handle, form a loop, so that the cane can be hung from a support, during non-usage, when fully assembled, or the cord may extend around the wrist of the user, in order to assure that the cane does not get separated or lost, when impact is encountered, which can be a very difficult task for the visually impaired to find it, on the ground, in the event that it is dropped. The cord around the wrist will keep the user fully connected with the cane, during its extended application.

In the connection of the handle to the upper segment of the cane, the handle telescopically fits for some distance over that upper segment, and then the bias of the spring therein, that extends between the upper end of the cane segment, to the interior of the upper end of the handle, places a compression type force between the handle and the upper segment, that allows the handle to slide further downwardly, upon the upper segment, when an obstruction is encountered, that abruptly stops the cane in place, as explained. The bungee type cord extending through the cane, its upper segment, and out the top of the handle, keeps the handle in place upon the cane, while at the same time, keeping a constant compression force upon the spring, so as to stabilize the assembly of the cane together, with its handle, in preparation for usage.

Various washers or fittings can be applied to the upper end of the cane, in order to locate the bungee cord therethrough, which can be tied in a knot at that location, to hold the segments together, or a washer may be included at the upper segment of the cane, and within the upper end of the handle, to assure that the bungee cord, when knotted, remains fixed in place for a length, but yet maintaining some compression upon the spring, to stabilize the application of the handle onto the various segments of the cane.

The white cane as designed provides for shock absorbing, through its handle, that gently retracts up to approximately 5 inches, when the cane strikes a solid object, and it has been determined that such action absorbs about 80% of the shock generated, with the handle automatically returning to its original position. This eliminates the sharp jab our gouge to the wrist or abdomen of the user, but does not take away from the sensitivity of the cane, during usage. It is believed that this is an enhancement in the usage of such a cane, and blind cane technology and development.

The handle, which may be of a high-quality 10.5 inch grip on the retractable handle which allows the user to use the longer cane than normal, but with much better control and more obstacle discovery of dangerous objects ahead. Various apertures or perforations may be provided within the leather handle, providing ventilation to help prevent sweaty hands from the user, which is more comfortable and allows a better grip upon the handle during usage. It is designed to be used in all weather conditions, whether it be very inclement weather, or even during hot, cold, rain or snow, as can occur.

The various materials that make up the cane segments, can be metal, thin tubular type, or it may be formed of carbon fiber and fiberglass, to form the various shaft segments, as can be understood. These combined types of materials make for a very strong and safe cane that resists cracking and breaking.

Hence, it is believed the enhancements generated through the construction of a white cane as identified, provides the following enhanced features. Initially, it uses a high-quality 10.5 inch, more or less, leather grip that is more durable and comfortable. It uses a 50-50 carbon fiber-fiberglass shaft, that is strong, and weighs only about 8 ounces. The shaft uses micromachined aluminum alloy type of sleeve or ferrule joints, to assure a firm and easy fit of the segments of the cane together. The exclusive shock absorbing handle can gently retract up to about 5 inches, on impact, to cushion such. Finally, the cord, or resilient or bungee type cord, that extends out of the handle, develops a nice large loop at the end of the grip that is designed to easily hold the cane, when it is folded to about 8-12 inches in length, for storage in a carrying bag.

The shock absorbing handle retracts about 5 inches upon impact of a solid object, as stated. A 9½ inch spring is placed inside the round 12 inch long tube which slides over the top end of the regular size white cane, within the handle. The spring rests against the upper end of the shaft segment of the cane, and the spring allows the shaft of the cane to retract inside the handle, when striking an object, and then returns to its original position. The entire cane is hollow, and is held together by an elastic cord, as noted, that is fastened at each end of the cane. The cane then folds into its 12 inch long sections, when they are separated from each other but retained together by means of a resilient or bungee type cord, and then placed into a package or carrying case, for conveyance or storage.

Another object of this invention is to provide a versatile white cane that accommodates usage by the visually impaired, can be retained to the wrist of the user, to assure that it is not lost or separated from the user, during application.

Another object of this invention is to provide a white cane with many versatile attributes, but at the same time, is very light of weight, and sensitive to the surroundings when used by the visually impaired when moving.

These and other objects may become more apparent to those skilled in the art upon review of the Summary of the Invention as provided herein, and upon undertaking a study of the Description of its Preferred Embodiment, in view of the drawings.

DESCRIPTION OF THE PREFERRED EMBODIMENT

As previously reviewed, the concept of this invention is essentially a lengthy type of white cane, one that may be collapsible to reduce its size for packaging and conveyance, but once assembled, incorporates resilient means, primarily in the form of a spring located in the handle region of the white cane, in order to cushion the impact when the lower tip of the cane encounters an obstruction, that impedes its further movement. When a white cane is used by the visually impaired, without any shock absorbing feature, and if it is used for any length of time, the hand and wrist holding the cane can get fatigued.

Figure 1:
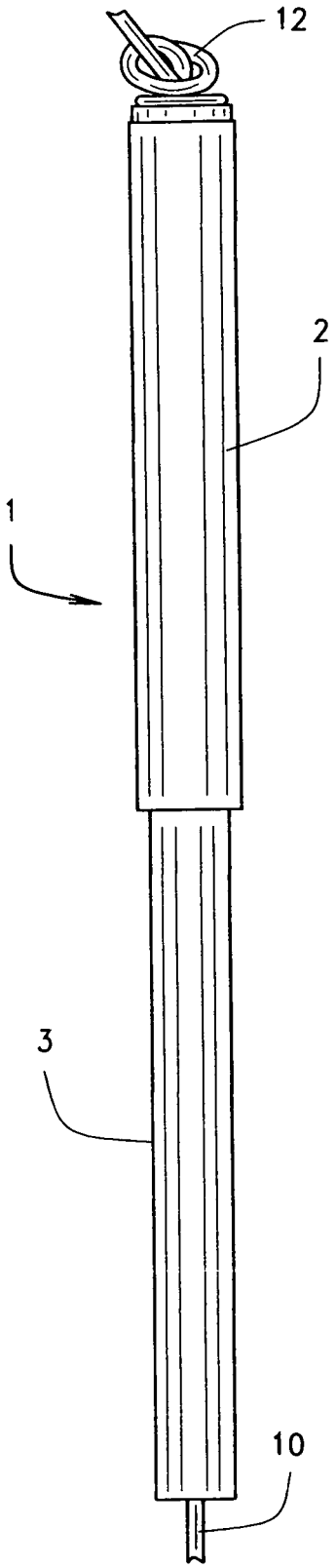
FIG. 1 shows a partial view of the white cane of this invention, showing its resilient handle, and its upper segment, and further disclosing the resilient cord that extends through the entire cane.

The structure of the preferred embodiment includes a white cane or walking stick type of structure, as noted at 1, in FIG. 1, which includes a handle portion 2 at its upper end, and which can be conveniently gripped by the user. The handle portion may be ergonomically designed, to facilitate its retention and holding by the user, during its application. The cane includes a series of length of segments, one as noted at 3, with the various segments being held together through the use of sleeves or ferrules, as noted at 4, in FIG. 4, so that when the various segments 3 are interconnected together, and held by their sleeves, as noted, they form a lengthy white cane, or walking stick, for the user. The handle 2 telescopically fits upon the upper segment 3, as noted, while the bottom segment includes a lower tip, as at 5, which is the portion of the cane that detects and encounters any obstacle, during its usage. And, as is commonly structured into such a white cane, there is generally a band of material, as at 6, normally red, so as to alert others that the user of the white cane is visually impaired, and that caution must be exercised.

Figure 2:
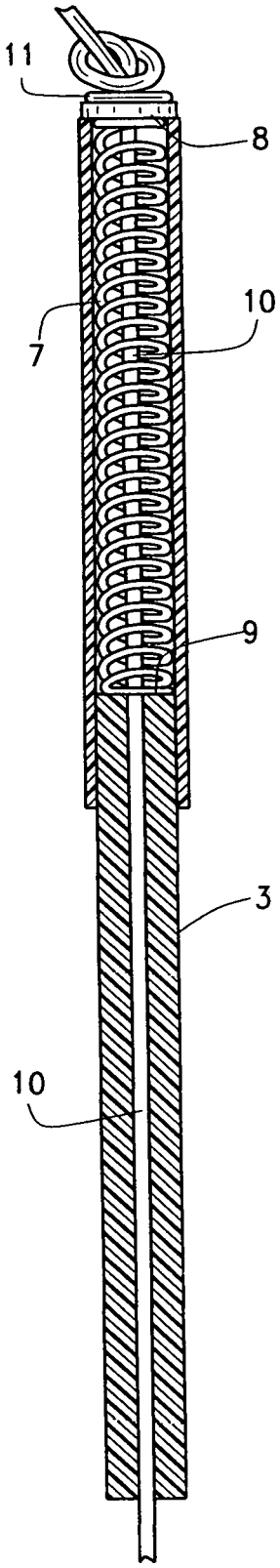
FIG. 2 is a sectional view showing the various internal components, including the compression or recoil spring, that hold the handle in position for movement, when an obstruction is encountered by the user.
Figure 4:
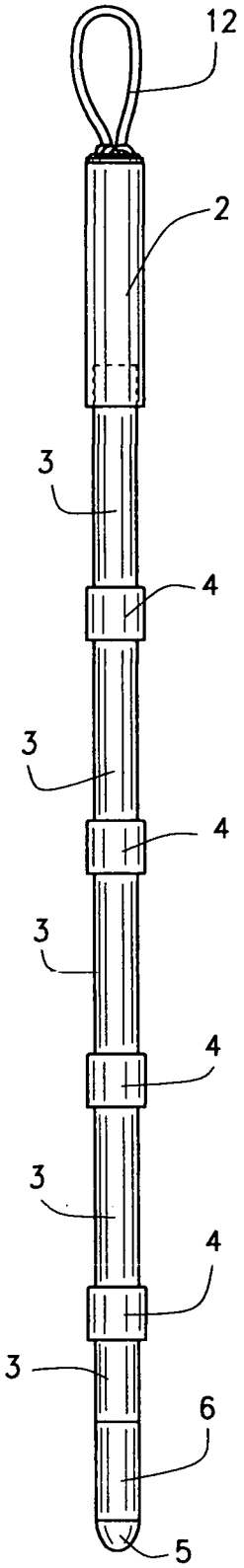
FIG. 4 shows a lengthy view of the entire white cane, its various segments, held together by ferrules, and having the handle located at its upper end, all the segments and the handle being held together through the usage of a resilient cord.

The upper handle 2, as stated, is telescopically located over the upper part of the upper segment 3 of the cane. This can also be seen in FIG. 2. Within this area, there is located a recoil or compression spring 7 that is arranged between the upper interior end of the handle, as noted at 8, and biases against the top 9 of the upper segment 3, of the structure. There is a resilient cord, similar to a bungee cord, as noted at 10, that extends entirely through the structured cane, securing interiorly at the tip 5 of the cane structure or to the bottom segment 3, extends upwardly, and is secured at the upper end 8, by means of a washer or other retainer, as at 11. The bottom end of the recoil spring 7 will bias upon the top of the segment 3, and there may be another washer (not shown) located at that location for stabilizing the bias of the recoil spring against it, at that location.

Where the upper end of the resilient cord extends exteriorly of the white cane, as noted at 12, it may be formed into a loop, as noted in FIG. 4, which provides for the convenience of holding by the user, or the cord loop may be wrapped around the wrist of the user, in order to provide for some securement of the white cane to the visually impaired, to assure that he/she can retain the cane, when any obstruction is encountered, in order to prevent its dropping, or loss.

Figure 3:
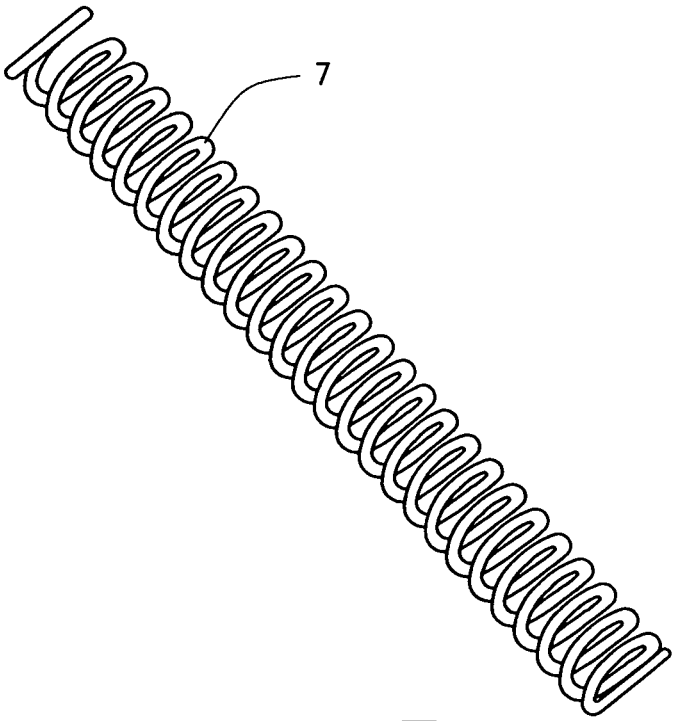
FIG. 3 provides a lengthy view of the recoil or compression spring that locates within the handle to add resiliency to the white cane, during its usage.

As previously reviewed, the recoil or compression spring 7 can contract approximately up to about 5 inches, on impact, in order to cushion the shock of encountering such an obstruction, and then can immediately extend to its normal condition, once the impact or obstacle has been removed. Such a compression spring 7 can be seen in FIG. 3, which discloses that the spring is capable of compression, retraction, when the white cane encounters any obstruction.

Figure 5:
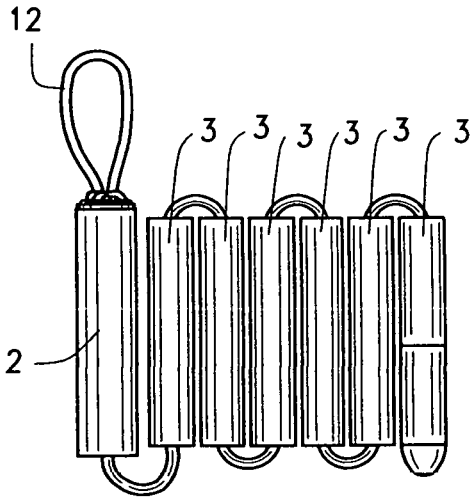
FIG. 5 shows how the various segments of the cane can be separated from each other, pulling against the resiliency of its internal cord, all the segments and the handle being held in adjacency, ready for packaging or storage.

FIG. 5 shows how the various segments of the cane can be separated, laid in adjacency, ready for packaging, or placing into a carrying bag, for just that, for conveyance, or for storage. As noted, the handle 2 and all of the segments of the cane, as at 3, can be pulled against the resistance of its resilient cord 10, so as to separate each segment 3 from its associated sleeve or ferrule 4, allowing the white cane to be contracted, down to approximately 12 inch segments, as can be noted. When collapsed in this manner, the various segments can be secured together, into a very condensed configuration, and can be packaged in a carrying bag, as can be understood. Even when in the bag, the upper loop of the cord 12 can extend out of the bag, and function as a handle.

Variations or modifications to the subject matter of this invention may occur to those skilled in the art upon review of the Description of the Preferred Embodiment as provided herein. Such variations, if within the spirit of this invention, are intended to be encompassed within the scope of any claims to patent protection issuing herein. The Description of the Preferred Embodiment, and its depiction in the drawings, are set forth for illustrative purposes only.

I claim:

1. A white cane for the visually impaired, including a lengthy cane made up of various segments, the various segments being interconnected together to form the length of the white cane, a handle provided upon the upper segment of the cane, a spring provided within the handle and biasing against the upper segment of the cane, the handle being telescopically applied to the upper segment, so that when an obstacle is encountered by the user, the compression spring cushions the impact relieving the user from stress to his/her hand during application of said device;

a resilient cord extending from the upper end of the handle, through the handle and it's in place spring, and through the various segments, and securing within the bottom most segment of the cane, to hold the segments of the cane and its handle together when assembled for usage, but to allow the various segments to be separated from each other, and from the handle, through stretching of said resilient cord, when dismantled for storage or conveyance;

ferrules or sleeves secure the various cane segments together during assembly; and said resilient cord extends above the cushioned handle for the cane, forming a loop, to provide for grasping or securement about the wrist of the user, to prevent inadvertent loss during usage of the said white cane.

* * * * *